US007815089B2

(12) United States Patent
Shor

(10) Patent No.: US 7,815,089 B2
(45) Date of Patent: Oct. 19, 2010

(54) FASTENER GUN

(75) Inventor: Ilya Shor, Brooklyn, NY (US)

(73) Assignee: Arrow Fastener Co., LLC., Saddle Brook, NJ (US)

( * ) Notice: Subject to any disclaimer, the term of this patent is extended or adjusted under 35 U.S.C. 154(b) by 167 days.

(21) Appl. No.: 12/188,593

(22) Filed: Aug. 8, 2008

(65) Prior Publication Data

US 2008/0290133 A1 Nov. 27, 2008

Related U.S. Application Data

(63) Continuation-in-part of application No. 11/685,281, filed on Mar. 13, 2007, now Pat. No. 7,637,407.

(51) Int. Cl.
*B25C 1/02* (2006.01)

(52) U.S. Cl. ..... 227/132; 227/134; 227/120; 227/146

(58) Field of Classification Search ..... 227/132, 227/134, 120, 146
See application file for complete search history.

(56) References Cited

U.S. PATENT DOCUMENTS

| | | | |
|---|---|---|---|
| 1,830,650 | A | 11/1931 | Falk |
| 2,028,350 | A | 1/1936 | Polzer |
| 2,493,640 | A | 1/1950 | Peterson |
| 2,617,097 | A | 11/1952 | Spencer |
| 2,746,043 | A | 5/1956 | Heller |
| 2,775,763 | A | 1/1957 | Flammer |
| 3,229,882 | A | 1/1966 | Abrams |
| 5,165,587 | A | 11/1992 | Marks |
| 5,328,075 | A | 7/1994 | Marks |
| 5,335,839 | A | 8/1994 | Fealey |
| 5,407,118 | A | 4/1995 | Marks |
| 5,427,299 | A | 6/1995 | Marks |
| 5,505,362 | A | 4/1996 | Marks |
| 5,511,716 | A | 4/1996 | Marks |
| 5,664,722 | A | 9/1997 | Marks |
| 5,699,949 | A | 12/1997 | Marks |
| 5,758,813 | A | 6/1998 | Kikuchi et al. |
| 5,765,742 | A | 6/1998 | Marks |
| 5,816,470 | A | 10/1998 | Plato et al. |
| 5,890,642 | A | 4/1999 | Sato |
| 5,979,736 | A | 11/1999 | Edeholt |
| 5,988,478 | A | 11/1999 | Marks |
| 6,789,719 | B2 | 9/2004 | Shor |
| 7,097,088 | B2 | 8/2006 | Shor |
| 7,637,407 | B2 * | 12/2009 | Shor ..... 227/132 |

* cited by examiner

*Primary Examiner*—Thanh K Truong
*Assistant Examiner*—Michelle Lopez
(74) *Attorney, Agent, or Firm*—Fitzpatrick, Cella, Harper & Scinto

(57) ABSTRACT

A fastener gun includes a housing having a plunger and a power spring for driving a fastener into a workpiece, and a trigger arm pivotally attached to the housing at a trigger pivot. One end of the trigger arm lifts the plunger to bias the power spring when the trigger arm pivots in a first direction toward the housing. A member contacting the trigger arm is provided that moves away from the trigger pivot as the handle moves toward the housing, so that force is applied at different locations on the trigger arm when the handle is squeezed, increasing the mechanical advantage of using the fastener gun.

11 Claims, 5 Drawing Sheets

FASTENER GUN

This application is a continuation-in-part of U.S. application Ser. No. 11/685,281, filed Mar. 13, 2007, which is incorporated herein by reference.

BACKGROUND OF THE INVENTION

Field of the Invention

This invention relates to a fastener gun for driving a fastener.

Fastener guns are known in the art and include a handle pivotally attached to a fastener gun housing. Rotating the handle toward the fastener housing biases a power spring. A user's hand, received on an end of the handle remote from the pivot, rotates the handle toward the fastener gun housing. Releasing the biased power spring moves a plunger (sometimes called the "knife") to drive a fastener into a workpiece.

Increasing the power spring's force allows a user to drive larger fasteners into a workpiece. However, such a power spring requires increased biasing forces. To increase forces available for biasing, some fastener guns increase the force required to rotate the handle toward the fastener housing. Some users are not able to exert the increased forces. Other users can exert the increased forces, but only through some of the range of handle travel. At some points of handle travel, exerting the increased forces is especially difficult, such as when initiating handle movement or just prior to releasing the power spring. Further, a user's hand can exert more force in some positions than in other positions.

To increase biasing forces without increasing the handle forces, some fastener guns increase the handle size. Other fastener guns may increase the handle size to achieve current biasing forces with reduced effort. Biasing forces may also be increased by increasing the distance that the handle travels in the direction of the housing. However, some users may be unable to effectively maneuver the larger handle, or a handle raised a larger distance from the housing, due to the user's hand size or other physical limitations. Therefore, it is desirable to lower the forces required to bias the power spring without increasing the handle size or raising the handle.

U.S. Pat. No. 5,165,587 teaches a "forward-acting" staple gun, in which the handle is hinged to the housing at the rear end, opposite from the end that the staples are ejected from. According to this design, the staple gun is provided with a squeeze lever, assembled in the staple gun handle so that squeezing the handle forces the squeeze lever in the direction of the staple gun housing. The force acting on the squeeze lever is transmitted to a force transmitting lever, pivoting with respect to the housing, which raises the plunger. Between the squeeze lever and the force transmitting lever is an engagement linkage which slides in a slot in the squeeze lever. However, the engagement linkage does not move with respect to the handle to afford greater leverage on the squeeze lever.

U.S. Pat. No. 6,789,719, by the inventor herein, also teaches a staple gun that uses a link element attached between the handle lever and the trigger lever. However, the trigger lever, as described therein, is not adapted to move in the handle away from the pivot point when the handle is depressed. Also, the link is not pivotally attached to the trigger arm and pivotally attached to the housing, to increase spring bias force without increasing the distance the handle must travel in the direction of the housing in order to bias the spring.

In general, and in view of the foregoing prior art, it would be desirable to increase the forces driving a fastener from a fastener gun while accommodating a user's hand.

SUMMARY OF THE INVENTION

An exemplary fastener gun according to the invention includes a housing having a plunger and a power spring for driving a fastener into a workpiece, a handle extending upwardly from the housing and pivotally attached to the housing at a handle pivot, and a trigger arm pivotally attached to the housing at a trigger pivot. When the handle and trigger arm pivot in a first direction toward the housing, the opposed end of the trigger arm lifts the plunger to bias the power spring. A member in the handle contacts the trigger arm, moving away from the trigger pivot as the handle moves toward the housing, thereby increasing leverage on the trigger arm.

In embodiments, a fastener gun according to the invention further comprises a link having a first portion pivotally attached to the housing and a second portion pivotally attached to the member that moves away from the trigger pivot when the handle moves toward the housing.

A fastener gun incorporating the foregoing elements includes a housing having a plunger and a power spring for driving a fastener into a workpiece, a handle extending upwardly from the housing and pivotally attached to the housing at a handle pivot, and a trigger arm attached to the housing at a trigger pivot. When the handle is pivoted toward the housing, the trigger arm attached to the housing pivots, which lifts the plunger to bias the power spring. A member contacting the trigger arm moves in the handle away from the trigger pivot as the handle pivots toward the housing, which changes the location of the force applied to the trigger arm. A link is provided with a first portion pivotally attached to the housing at a link pivot and a second portion linked to the member contacting the trigger arm. This action increases mechanical advantage of applying force to the handle, because the distance between the trigger pivot and the point where force is applied on the trigger arm increases, while the distance between the link pivot and the point where the member contacts the trigger arm remains substantially constant.

Another aspect of the invention is a method of making a fastener gun to increase the mechanical advantage in biasing the power spring. The method comprises providing a plunger and a power spring in a housing, attaching a handle to the housing at a handle pivot, and attaching a trigger arm to the housing at a trigger pivot, such that pivoting the handle toward the housing causes the trigger arm to pivot to lift the plunger. A link is provided having a first portion pivotally attached to the housing at a link pivot and a second end linked to a member which contacts the trigger arm. When the handle is pivoted toward the housing, the member moves in the handle away from the trigger pivot, while the distance between the member contacting the trigger arm and the link pivot remains substantially constant.

The various features and advantages of this invention will become apparent to those skilled in the art from the following detailed description. The accompanying drawings can be briefly described as follows.

DETAILED DESCRIPTION OF THE PREFERRED EMBODIMENT

Figure 1:
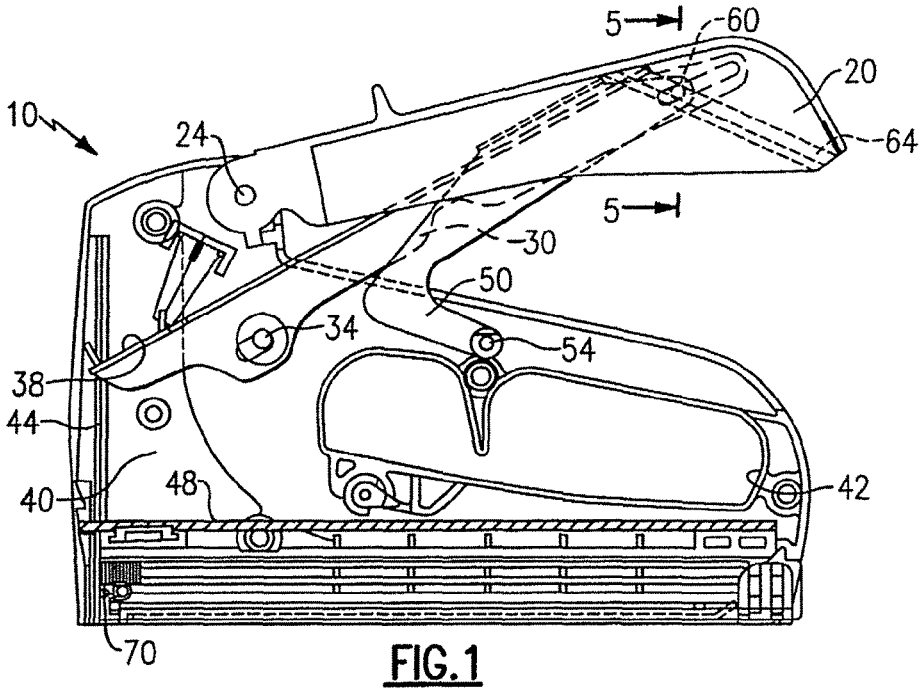
FIG. 1 shows a fastener gun in a relaxed position.

An exemplary fastener gun 10 according to a first embodiment includes a handle 20 and a trigger arm 30 connected to a housing 40, as shown in FIG. 1. The handle 20 pivotally connects to the housing 40 at a handle pivot 24. The trigger arm 30 pivotally connects to the housing 40 at a trigger pivot 34. Moving the handle 20 toward the housing 40 pivots the trigger arm 30 about the trigger pivot 34 to lift a plunger 44 with a trigger portion 38 of the trigger arm 30. As may be readily ascertained from the various Figures, moving the trigger arm in a first direction causes the trigger arm to pivot in one direction on one side of the trigger pivot 34 (in the direction of squeezing the handle) and upward on the other side of the trigger pivot 34 (in the direction of lifting plunger). Lifting the plunger 44 biases a power spring 48, shown in FIG. 1 in an unbiased position. As known, releasing the power spring 48 from a biased position forces the plunger 44 to drive a fastener 70 from the fastener gun 10. Rotating the handle 20 rotates the trigger portion 38 to a position that releases the plunger 44. A portion of the housing 40 has been removed in FIG. 1 to illustrate the interior of the fastener gun 10.

Figure 2:
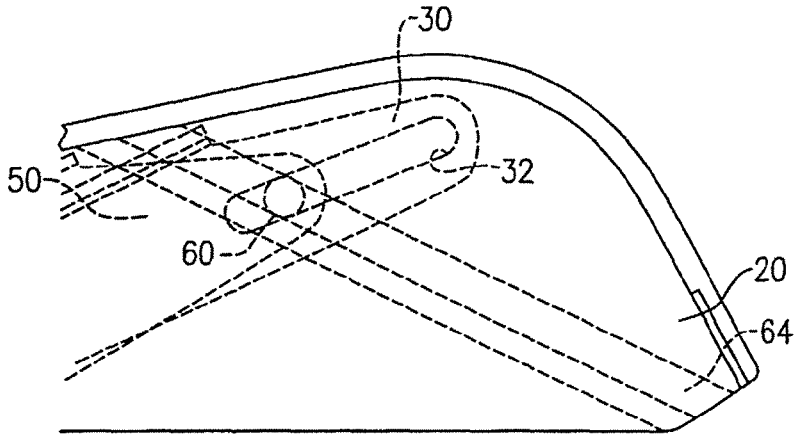
FIG. 2 shows a close-up view of the rear portion of a handle in a first embodiment thereof.

In the embodiment shown in FIG. 2, the handle 20 includes two handle slots 64 for controlling movement of a member adapted to move away from the trigger pivot when the handle moves toward the housing, in this case, roller 60. The trigger arm 30 includes a pair of trigger apertures 32 engaging the roller 60. A link 50 pivotally connects to the roller 60 and the housing 40 at a link pivot 54. The roller 60 moves within the trigger apertures 32 and the handle slots 64 as the handle 20 moves toward the housing 40.

A user's fingers grasp an opening 42 on the housing 40 while the user's palm moves the handle 20 toward the housing 40. The force applied moves the handle 20 toward the housing 40. The roller 60 within the handle 20 transfers force applied to the handle 20 to the trigger arm 30, which forces the trigger arm 30 toward the housing 40. Moving the handle 20 causes movement of the roller 60 within the handle slots 64 and the trigger apertures 32. As the handle 20 moves toward the housing 40, the roller 60 moves away from the trigger pivot 34. As the handle 20 moves away from the housing 40, the roller 60 moves toward the trigger pivot 34. Thus the location of the force applied to the trigger arm 30 relative to the trigger pivot 34 depends on the location of the handle 20 relative to the housing 40.

Figure 3A:
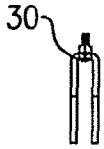
FIG. 3A shows a first view of a trigger arm.
Figure 3B:
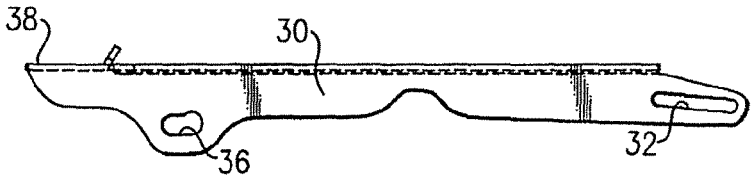
FIG. 3B shows a second view of the trigger arm.

The trigger arm 30 shown in FIGS. 3A and 3B includes trigger apertures 32 that permit movement of the roller 60 (FIG. 2) within the handle slots 64. Movement of the roller 60 within the trigger apertures 32 changes the roller 60 location relative to the trigger pivot 34.

Figure 7:
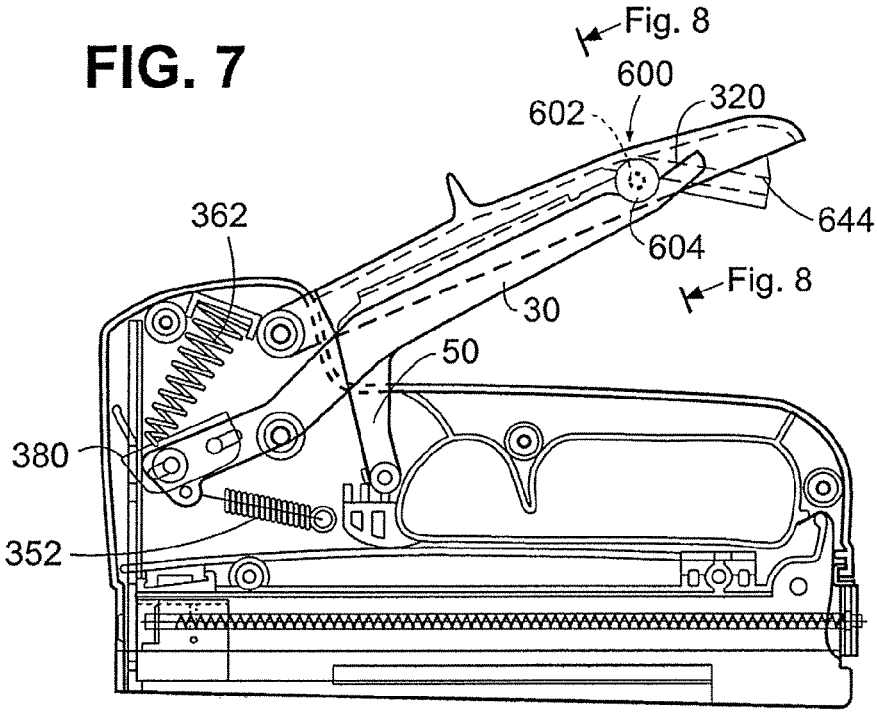
FIG. 7 shows an embodiment of the fastener gun with modifications to the trigger arm assembly and link assembly.
Figure 8:
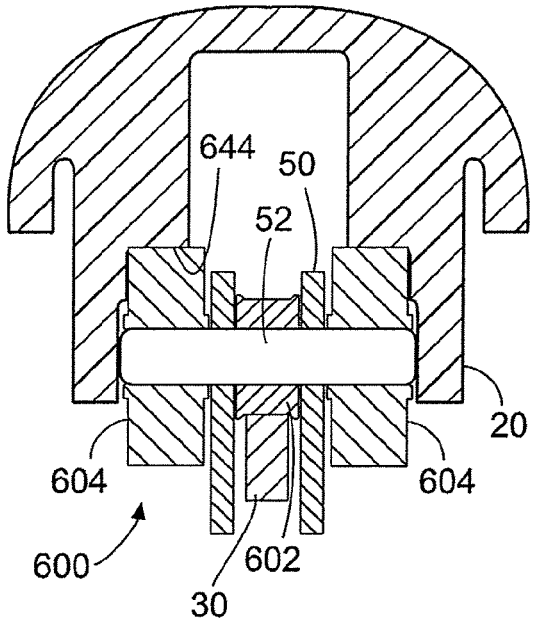
FIG. 8 shows a section view through line 8-8 of FIG. 7.

Another member or assembly may be used in place of roller 60 so that force can be applied at different locations on the trigger arm 30 when handle 20 is pivoted toward the housing. For example, the member may comprise an assembly 600 having a plurality of rollers adapted with bushings to rotate in opposite directions, as shown in FIGS. 7 and 8. This arrangement addresses the opposing frictional forces exerted on the member by the handle and the trigger arm at that point.

In FIG. 7, assembly 600 comprises a plurality of rollers 602, 604. A first roller 602 is guided away from the trigger pivot 34 along top surface 320 of the trigger arm when handle 20 is depressed, which changes the location of the force applied to the trigger arm 30. At least one second roller 604 is guided along an upper surface 644 in the handle, rotating in the opposite direction from roller 602. In FIG. 7, assembly 600 is guided along beveled surface 320. However, apertures 32, shown in FIG. 2, could also be employed for this purpose.

FIG. 8 is a cutaway view taken along line 8-8 in FIG. 7 and shows first roller 602 contacting the trigger arm and two second rollers 604 provided on opposite sides of the first roller, guided in similar ledges 644 on opposite sides of the handle. Second rollers 604 are subject to frictional forces opposed to the forces applied on first roller 602, and therefore they rotate in the opposite direction. Rollers may be supported on pin 52 with appropriate bushings as known in the art.

Link 50 is formed with an angle, making a dogleg profile, and is attached to the housing at link pivot 54, so as to provide a substantially constant distance between the link pivot and the member applying force to the trigger arm, such as assembly 600. This arrangement increases the mechanical advantage of applying biasing force to the power spring. As the link 50 is pivoted toward the housing, the assembly 600 moves away from the trigger pivot, which increases the distance between the trigger pivot and the point where force is applied to the trigger arm, while at the same time, a substantially constant distance is maintained between the trigger pivot 54 and the assembly 600. A "substantially constant" distance, in this context, means that the distance increases not at all, or increases at a lower rate compared to the increase in the distance between the assembly 600 and the trigger pivot 34 as the trigger arm 30 is pivoted toward the housing.

Figure 3C:
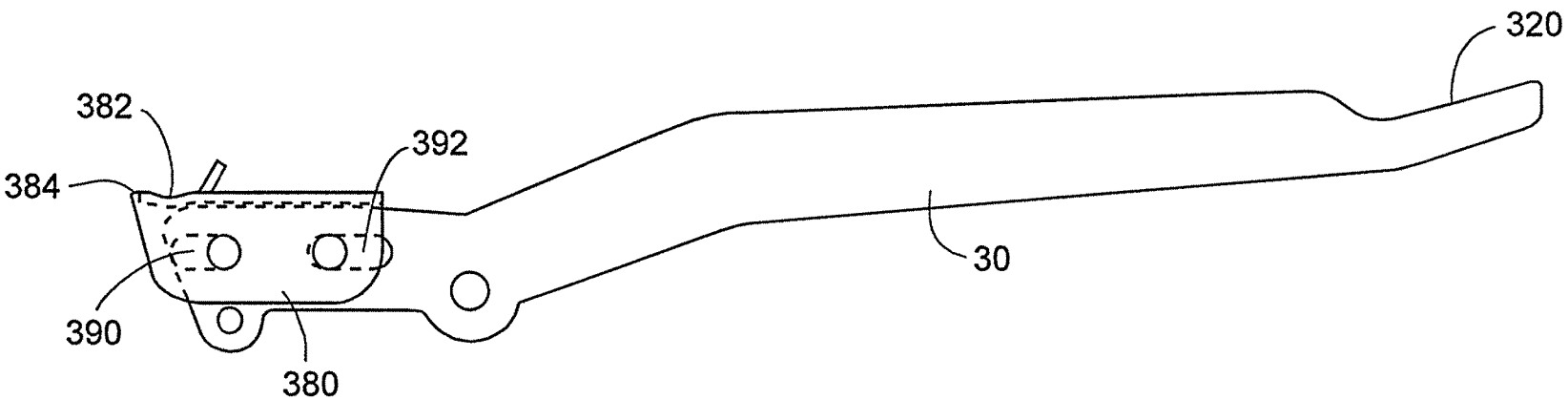
FIG. 3C shows a trigger arm assembly.

As shown in FIG. 3C, the trigger arm 30 may further comprise trigger element 380 which together with the trigger arm forms a trigger assembly improving the interface between the trigger arm and an aperture (not shown) in the plunger that the trigger arm engages to lift the plunger. Means on the trigger arm 30, such as apertures 390 and 392 engage positive elements on the trigger arm (or vice versa) and permit the trigger element to slide on trigger arm 30. Appropriate trigger arm return means such as a conical spring 362 (shown in FIG. 7) may be used for engaging the trigger arm with the plunger 44. A spring 352 attaching the trigger arm element to the housing, or equivalent means, may be used to return the trigger assembly to its condition before use. The trigger element 380 may be provided with a groove 382 which engages the aperture in the plunger. The bottom of the groove has a reduced height with respect to the plunger which permits the handle to be depressed some distance before the power spring begins to be biased by the action of the trigger element 380 on the plunger. This makes it easier to move the handle 20 when it is at the beginning of its pivoting motion, at the farthest point from the housing, where a user may find the fastener gun cumbersome to operate. As the handle is depressed further, lip 384 engages the aperture in the plunger, which permits the spring to be biased to the same extent (and the plunger to be lifted to the same height) as it would be if the trigger did not have a groove.

Figure 4A:
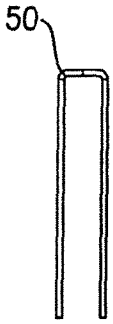
FIG. 4A shows a first view of a link.
Figure 4B:
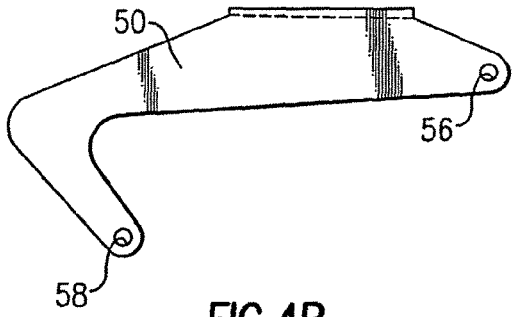
FIG. 4B shows a second view of the link.

Returning to the previous embodiment, a portion of the trigger arm 30 nests within the link 50 shown in FIGS. 4A and 4B. The link 50 includes a first end that pivotally attaches to the housing 40 at the link pivot 54. A second end of the link 50 pivotally connects to the roller 60 within the handle 20. The link 50 includes a link aperture 56 for controlling movement of the roller 60 within the handle slots 64 and the trigger apertures 32. The link 50 helps initiate and control the roller 60 movement when the handle 20 moves. The link 50 includes a second link aperture 58 for engaging the link pivot 54 of FIG. 1. The link aperture 56 engages the roller 60. The sizing of the second link aperture 56 limits the roller 60 movements relative to the link 50. Accordingly, the distance between the link pivot 54 and the roller 60 remains substantially fixed throughout the handle 20 travel. The link 50 has general dogleg profile to facilitate nesting portions of the link 50 within the handle 20. A similar nesting configuration is shown in FIG. 8, where the member contacting the trigger arm comprises assembly 600 linking the link and the trigger arm 30.

Figure 5:
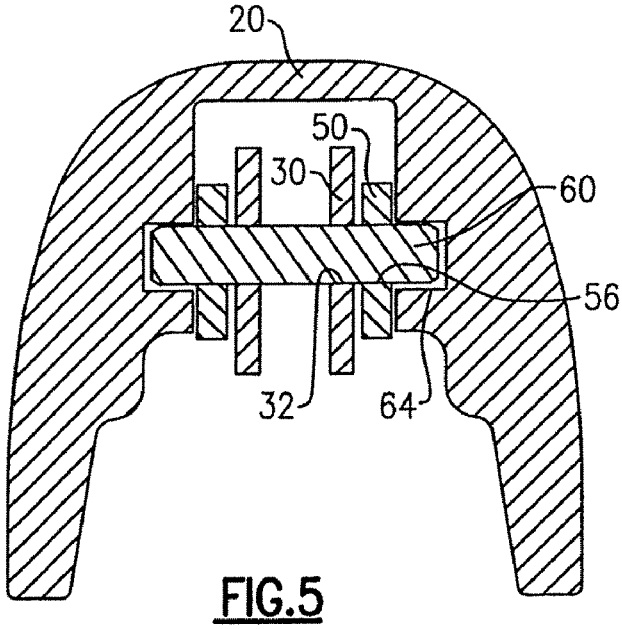
FIG. 5 shows a section view through line 5-5 of FIG. 1.

As shown in the cross-sectional view of FIG. 5, the trigger arm 30, the link 50, and the roller 60 nest within the handle 20. The roller 60 transfers movement of the handle 20 to the trigger arm 30 and the link 50. As the handle 20 moves, the roller 60 moves within the handle slots 64 (FIG. 1). The trigger arm 30 and the link 50 also move with the handle 20. Again, the same general observations apply if assembly 600 is used in place of roller 60.

Figure 6:
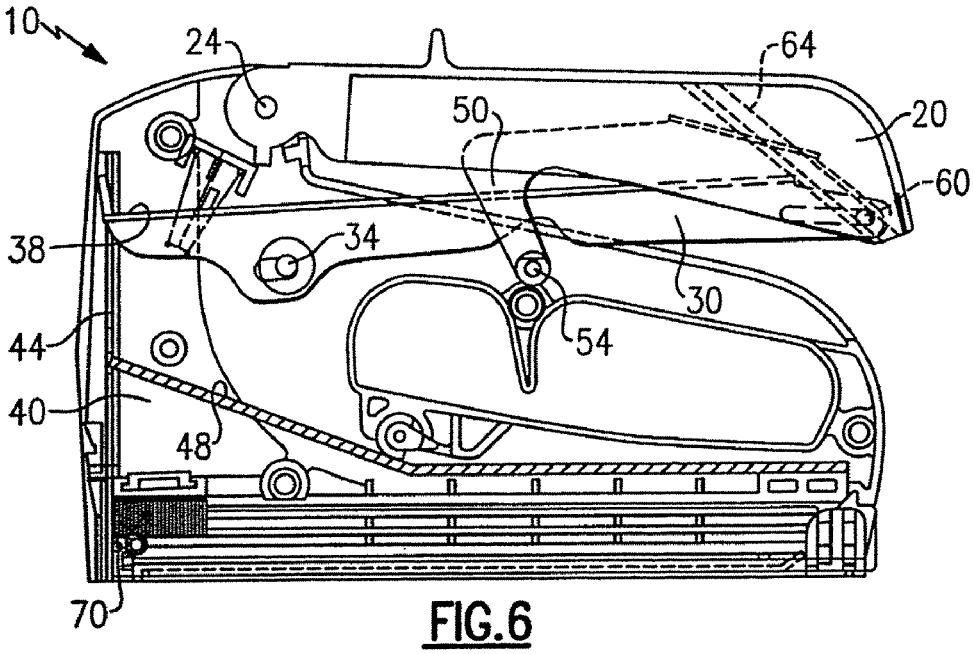
FIG. 6 shows the fastener gun with the handle in a spring biasing position.

The fastener gun 10 in FIG. 6 illustrates the power spring 48 in a biased position prior to ejecting the fastener 70. Portions of the housing 40 have been removed to reveal detail within the fastener gun 10. In the position shown, the handle 20 is closer to the housing 40 than the position of the handle 20 in FIG. 1. Moving the handle 20 further toward the housing 40 rotates the trigger portion 38 to a position that releases the plunger 44. Releasing the plunger 44 causes the power spring 48 to move from the biased position to force the plunger 44 to eject the fastener 70 from the housing 40. In this example, the fastener 70 is a staple. Other examples may include nails. Providing a magazine at the bottom of the gun adapted for delivery of these and other fasteners is within the skill of one of ordinary skill in the relevant art.

Moving the roller 60 within the handle slots 64 causes the location of the force applied to the trigger arm 30 to change as the handle 20 rotates about the handle pivot 24. In this example, the forces needed to bias the power spring 48 increase as the power spring 48 moves further from an unbiased position. Moving the roller 60 permits the forces exerted by the user on the handle 20 to remain relatively constant as the handle 20 rotates toward the housing 40. Increasing the distance between the applied force and the trigger pivot 34 increases the force applied to the plunger 44 by the trigger portion 38 instead of relying on the user to apply increased forces to the handle 20. Increasing the distance between the user applied force and the trigger pivot 34 as the handle 20 moves closer to housing 40 compensates for the increasing force applied to the plunger 44 by the power spring 48 as the power spring 48 moves away from the unbiased position.

Changing the geometry of the handle slots 64 or ledge 644 can affect the movement of the roller 60, such as by increasing the rate of change in force applied to the trigger arm 30. In embodiments the slots 64 have sidewalls. However, it is preferred to use an open slot or ledge 644 with a bearing surface on an upper portion of the handle. Likewise, aperture 32 in the trigger arm 30 may be replaced with a bearing surface 320, which may reduce frictional forces.

In another example, if applying a constant force to the handle 20 is desired, increasing the distance between the applied force and the trigger pivot 34 compensates the increased force on the plunger side of the trigger. This permits the travel (or rotation angle) of the handle needed to lift the plunger to be reduced. Providing slots 64, or surface 644, cooperating with rollers, allows the rotation of the trigger arm to accelerate as it moves. Thus lifting the knife to a given height may be accomplished with about 20% less travel than if the handle were attached directly to the trigger arm.

Although preferred embodiments of this invention have been disclosed, one of ordinary skill in this art would recognize that certain modifications now shown herein would come within the scope of this invention. For that reason, the following claims should be studied to determine the true scope and content of this invention.

What is claimed is:

1. A fastener gun, comprising:

a housing including a plunger and a power spring for driving a fastener into a workpiece;

a handle extending upwardly from said housing and pivotally attached to said housing at a handle pivot;

a trigger arm pivotally attached to said housing at a trigger pivot, said trigger arm operable to lift said plunger to bias said power spring when said trigger arm pivots in a first direction;

a member guided on a surface in the handle, contacting the trigger arm and transferring force applied to the handle to the trigger arm, wherein said member moves in the handle away from said trigger pivot when said handle pivots toward the housing; and a link having a first portion pivotally attached to said housing and a second portion pivotally attached to said member.

2. The fastener gun of claim 1, wherein said member is an assembly comprising a plurality of rollers.

3. The fastener gun of claim 2, wherein said assembly comprises a first roller contacting the trigger arm and at least one second roller contacting a surface in the handle, said first roller and said at least one second roller adapted to rotate in opposite directions as the assembly moves along said surface in the handle in a direction away from the trigger pivot.

4. The fastener gun of claim 3, wherein said assembly comprises two second rollers arranged on opposite sides of said first roller, each said second roller contacting an inside upper surface of the handle, and the first roller contacting a beveled surface of the trigger arm.

5. The fastener gun of claim 2, wherein the link is angled and is attached to the housing at a link pivot, such that the distance between the link pivot and the member contacting the trigger arm remains substantially constant when the member moves away from the trigger pivot.

6. The fastener gun of claim 1, wherein said trigger arm includes a top surface for guiding movement of said member.

7. The fastener gun of claim 1, wherein said link is u-shaped and said trigger arm nests within said link.

8. The fastener gun of claim 7, wherein said link nests within said handle.

9. The fastener gun of claim 1, wherein the trigger arm further comprises a trigger element slidably attached to the trigger arm and engaging an aperture in the plunger.

10. The fastener gun of claim 9, wherein the trigger element has a groove adapted to engage an upper surface of the aperture in the plunger.

11. The fastener gun of claim 10, further comprising a lip formed at the end of the trigger element adjacent the groove, the lip having a raised height with respect to the groove, which increases the height to which the trigger arm can raise the plunger as the trigger element slides toward the trigger pivot point.

* * * * *